US010870064B1

(12) United States Patent
Standing et al.

(10) Patent No.: US 10,870,064 B1
(45) Date of Patent: Dec. 22, 2020

(54) REMOTE CONTROLLED DEVICE WITH SELF ALIGNING MAGNETICALLY BIASED ACCESSORY

(71) Applicant: Hasbro, Inc., Pawtucket, RI (US)

(72) Inventors: Sheila Driscoll Standing, Wrentham, MA (US); Christopher Whipple, Jr., Exeter, RI (US); Steven Unruh, Cranston, RI (US)

(73) Assignee: HASBRO, INC., Pawtucket, RI (US)

( * ) Notice: Subject to any disclaimer, the term of this patent is extended or adjusted under 35 U.S.C. 154(b) by 646 days.

(21) Appl. No.: 15/191,676

(22) Filed: Jun. 24, 2016

Related U.S. Application Data

(60) Provisional application No. 62/184,177, filed on Jun. 24, 2015.

(51) Int. Cl.

| | |
|---|---|
| ***A63H 17/26*** | (2006.01) |
| ***A63H 33/26*** | (2006.01) |
| ***A63H 33/00*** | (2006.01) |
| ***A63H 30/04*** | (2006.01) |

(52) U.S. Cl.
CPC ..... *A63H 17/26* (2013.01); *A63H 30/04* (2013.01); *A63H 33/005* (2013.01); *A63H 33/26* (2013.01)

(58) Field of Classification Search
CPC ..... A63H 17/26; A63H 33/26; A63H 33/005
See application file for complete search history.

(56) References Cited

U.S. PATENT DOCUMENTS

| | | | | |
|---|---|---|---|---|
| 561,777 A | | 6/1896 | Essberger et al. | |
| 2,702,191 A | * | 2/1955 | Lemelson | F41J 7/04 273/393 |
| 3,696,557 A | * | 10/1972 | Ruppel | A63H 33/005 446/444 |
| 4,541,814 A | * | 9/1985 | Martin | A63H 33/005 446/456 |
| 4,589,174 A | | 5/1986 | Allen | |
| 4,601,675 A | | 7/1986 | Robinson | |
| 5,533,921 A | | 7/1996 | Wilkinson | |
| 5,676,582 A | * | 10/1997 | Lin | A63H 33/005 446/130 |
| 5,692,946 A | * | 12/1997 | Ku | A63H 33/005 446/456 |
| 5,865,661 A | * | 2/1999 | Cyrus | A63H 18/14 446/136 |

(Continued)

FOREIGN PATENT DOCUMENTS

| | | | |
|---|---|---|---|
| CN | 20122011 Y1 | * | 4/2009 |
| CN | 201220111 U | | 4/2009 |

OTHER PUBLICATIONS

CN20122011Y_MT, machine translation of Chinese to English of CN20122011Y.*

*Primary Examiner* — Eugene L Kim
*Assistant Examiner* — Alyssa M Hylinski
(74) *Attorney, Agent, or Firm* — Perry Hoffman

(57) ABSTRACT

Disclosed is a self-aligning magnetic stationary accessory for use atop a spherical RC controlled self-propelled device. A novel device is employed includes a toy robot having first and second pairs of magnets aligned respectively with opposite polarities disposed in the stationary accessory. The spherical body with its stationary accessory allow the user to simply and precisely navigate the spherical body in a particular orientation for optimal RC controlled manipulation of the robot by a user.

20 Claims, 6 Drawing Sheets

(56) References Cited

U.S. PATENT DOCUMENTS

| | | | | |
|---|---|---|---|---|
| 5,913,707 | A * | 6/1999 | Roman | A63H 33/26 428/16 |
| 5,984,757 | A * | 11/1999 | Tsai | A63H 13/12 335/219 |
| 6,056,619 | A | 5/2000 | Wiggs et al. | |
| 6,824,441 | B1 | 11/2004 | Wiggs et al. | |
| 7,798,050 | B2 | 9/2010 | Sembtner | |
| 8,269,447 | B2 | 9/2012 | Smoot et al. | |
| 9,090,214 | B2 * | 7/2015 | Bernstein | B62D 61/00 |
| 9,968,864 | B2 * | 5/2018 | Clarke | G05D 1/0225 |
| 10,399,620 | B2 * | 9/2019 | Zhang | B60R 11/04 |
| 10,596,477 | B1 * | 3/2020 | Whipple, Jr. | A63H 33/26 |
| 2011/0014848 | A1 * | 1/2011 | Law | A63H 13/00 446/330 |
| 2011/0248807 | A1 * | 10/2011 | Wang | A63H 33/26 335/296 |
| 2011/0294397 | A1 * | 12/2011 | Tsai | A63H 33/005 446/454 |
| 2014/0345957 | A1 | 11/2014 | Bernstein et al. | |
| 2015/0224941 | A1 * | 8/2015 | Bernstein | A63H 33/005 180/167 |
| 2017/0010607 | A1 * | 1/2017 | Barlas | H04N 5/2252 |

* cited by examiner

REMOTE CONTROLLED DEVICE WITH SELF ALIGNING MAGNETICALLY BIASED ACCESSORY

PRIORITY CROSS-REFERENCE TO RELATED APPLICATION

This application claims priority pursuant to 35 U.S.C. 119(e) from U.S. Provisional Patent Application No. 62/184,177, filed on Jun. 24, 2015.

FIELD OF THE INVENTION

The present invention relates to RC controlled spherical robots, and more particularly, to a self-aligning magnetic stationary accessory for use atop a spherical RC controlled self-propelled device or the novel device includes a toy robot employing first and second pairs of magnets aligned with opposite polarities disposed in the stationary accessory and a spherical body, respectively, to simply yet precisely maintain the stationary accessory on the spherical body in a particular orientation for optimal RC controlled manipulation of the robot by a user.

BACKGROUND OF THE INVENTION

There are several known robotic spheres with various drive mechanisms and remote control transmitters. Some of the robotic spheres include magnetic connections between members or parts of the toy, and there are also some known self-propelled devices, or robotic spheres, which include magnetically coupled accessories and magnetically propelled drive systems.

None of the known devices however, employ pairs of oppositely polarized magnets which self-orientate a stationary accessory on a spherical body for the advantageous operation of the robot, e.g. to maintain head and eye orientations on the robot body. Additionally, the stationary accessory may facilitate use to indicate the particular orientation of a drive mechanism during use for optimizing RC controlled manipulation of the robotic device by a user.

Additionally, none of the known robotic spheres teaches an arcuate support structure disposed within the spherical body and supporting a pair of magnets riding along an inner surface of the spherical body creating attractive forces that secure the stationary accessory in a self-oriented position.

Known mechanized balls and remote controlled movable balls are exemplified and disclosed in U.S. Pat. No. 4,601,675 issued Jul. 22, 1986 to Robinson and U.S. Pat. No. 5,533,921 issued Jul. 9, 1996 to Wilkinson, and whose teachings are herein incorporated into the present application by reference. Robinson teaches a mechanized ball with a hollow sphere having a removable hatch and powered by a driving unit placed within the sphere. The drive unit is a single powered driving wheel or self-contained four wheeled toy vehicle guided by a strut or spring device biasing the toy vehicle to the interior surface of the sphere. The toy vehicle or driving wheel climbingly engage the interior of the sphere propelling it forward.

Wilkinson teaches a remote controlled movable ball amusement device including a hollow sphere containing two propulsion mechanisms driven on separate tracks within the sphere. Each of the propulsion mechanism includes a drive unit and a receiver. A remote transmitter send signals to the receivers actuating a respective drive unit and operating each propulsion unit independently to permit a user to vary the movement of the sphere. Neither Robinson nor Wilkinson teach a self-aligning stationary accessory for a spherical RC controlled robot.

Known self-propelled device having a spherical housing and including an accessory component magnetically interacting with the spherical housing is exemplified and disclosed in US Patent Application Publication No. US 2014/0345957 published Nov. 27, 2014 to Bernstein et al. and whose teachings are herein incorporated into the present application by reference. Bernstein teaches a self-propelled device having a spherical housing and an internal drive system including one or more motors. The internal drive system includes wheels that drive along an interior surface of the spherical housing propelling the device. A biasing mechanism, including a spring, couples to the drive system at one end, and includes an opposite end that contacts the interior surface of the spherical housing. An accessory component including a fixed magnet is magnetically coupled to the housing at a point where the spring end contacts the housing interior surface. The magnet in the accessory component is attracted to the metal spring inside the housing and the accessory component is maintained in a stable position on the housing exterior at the spring end. Bernstein does not teach or disclose first and second magnet pairs with alternating polarities coupling a stationary accessory to a spherical housing in a self-aligning position for optimal RC controlled manipulation of the robot by a user.

A known robotic sphere having a holonomic drive maintained at a relative position with respect to a sphere is exemplified and disclosed in U.S. Pat. No. 8,269,447 issued Sep. 18, 2012 to Smoot et al. The holonomic drive is urged against the sphere by way of a magnetic interaction between an interior drive and an exterior drive such that motion of the sphere is controlled by controlling the position of the drives with respect to the sphere. Interior and exterior drives each include one or more multidirectional wheels in contact with a sphere wall. A magnetic interaction between interior and exterior drives urge the drives against the sphere wall, and alternating magnet polarities couple the drives together and sandwich the sphere wall between the drives. The magnetic interaction between the first and second drives produce an urging force against the sphere wall such that the drives will remain engaged with the sphere wall and move as a unit with respect to the sphere driving movement of the sphere along a surface. Smoot et al does not teach or disclose a stationary accessory magnetically coupled through alternating polarities to a spherical housing in a self-aligning position indicating the specific orientation of an internal drive mechanism during use for optimal RC controller operations of a robot.

Other known arrangements for magnetic interactions and movements of devices by magnetics include Wiggs et al. U.S. Pat. Nos. 6,824,441 and 6,056,619. Such known devices however, do not maintain use of a stationary accessory but to the contrary, such prior art represents use of magnetic interactions for affecting movement.

SUMMARY OF THE INVENTION

The present invention addresses shortcomings of the prior art to provide a self-aligning stationary accessory for an RC controlled robot secured to a spherical body in a self-orientated position indicating the specific orientation of an internal drive mechanism during use for optimal RC controller operations of the robot.

In one embodiment of the invention, a self-aligning stationary accessory for an RC controlled robot includes, a stationary accessory, a first pair of magnets disposed within the stationary accessory with each one of the first pair of magnets having a polarity orientation opposite each other, a spherical body having an external surface supporting the movable member and an inner surface. A drive mechanism is disposed within the spherical body and controlled by an RC controller for propelling the spherical body back and forth along a surface. A support member is further disposed within the spherical body, opposite the location of the drive mechanism, and a second pair of magnets is disposed on the support member within the spherical body disposing the second pair of magnets to ride along the inner surface of the spherical body. Each of the second pair of magnets has a polarity orientation opposite the other. The second pair of magnets attract the opposite polarities of the first pair of magnets within the stationary accessory creating attractive forces that maintain the stationary assembly to the spherical body in an aligned self-oriented position indicating the specific orientation of the internal drive mechanism during use for optimal RC controller operations of the robot.

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
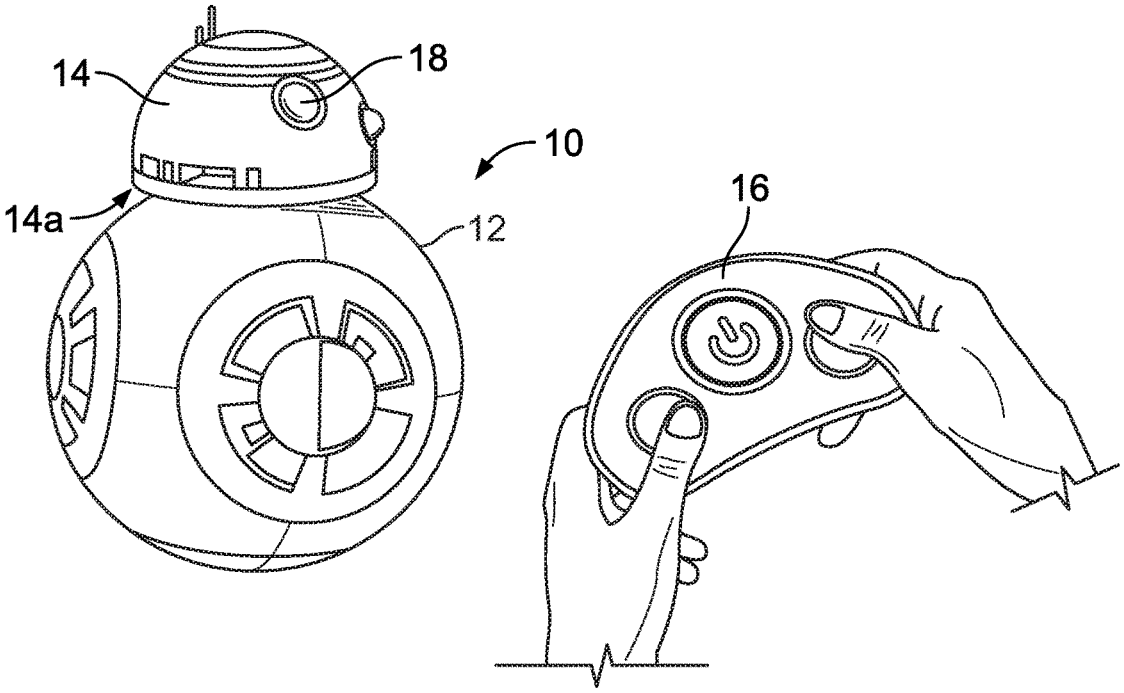
FIG. 1 is a perspective view of an RC controlled self-propelled device or spherical toy robot of the present invention.
Figure 2A:
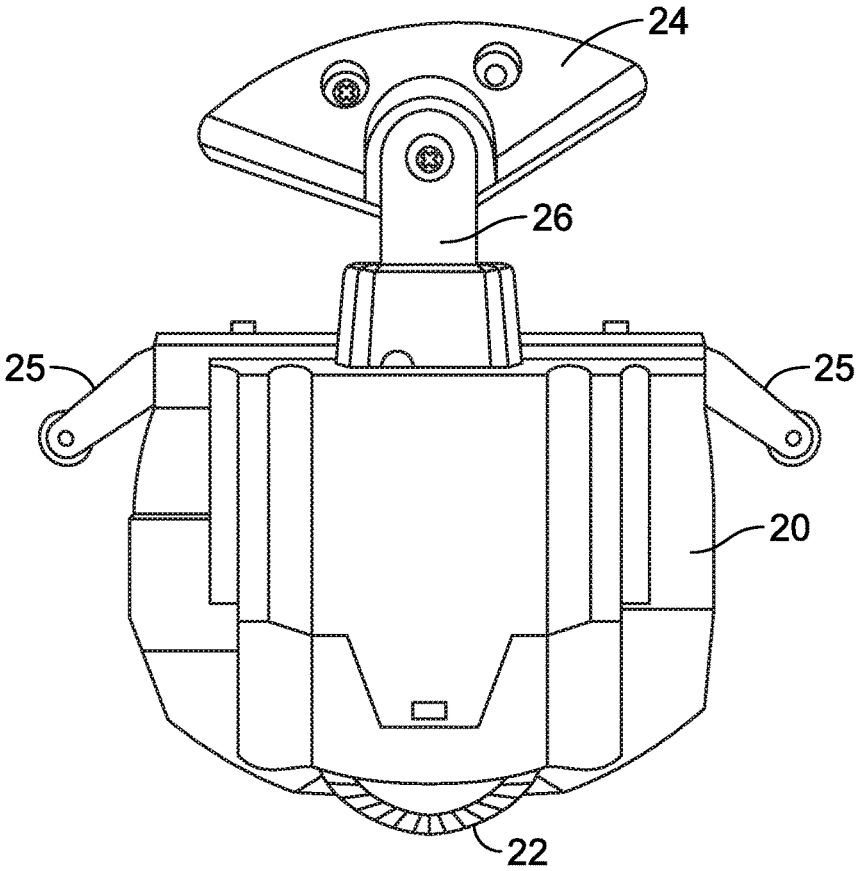
FIGS. 2A and 2B are views of the internal drive mechanism of the self-propelled device and an arcuate support structure.
Figure 2B:
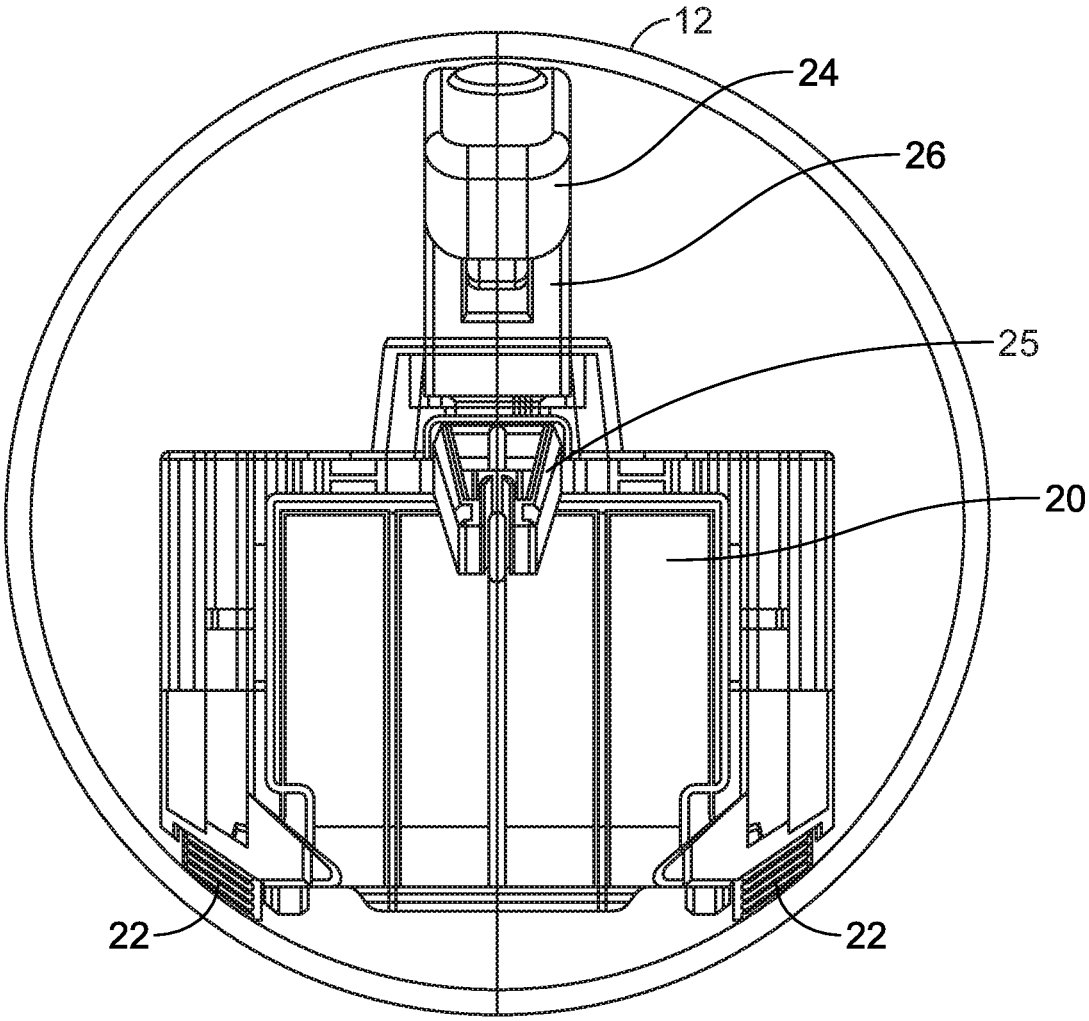
Figure 3:
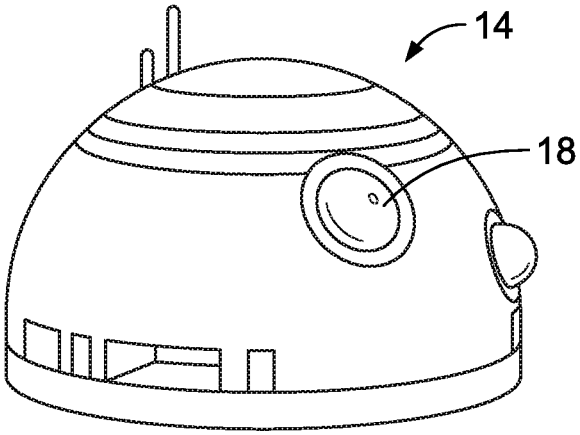
FIG. 3 illustrates a stationary accessory for use atop the spherical RC controlled device.

A self-aligning stationary accessory for use atop a spherical RC controlled self-propelled device or robot 10, as shown in FIG. 1, is generally seen to include a spherical body 12 and a stationary accessory 14 maintained in a specific orientation atop the spherical body. An RC controller 16 is used to manipulate the self-propelled device or robot driving the device back and forth along a surface. The stationary accessory maintains a particular orientation on the spherical body during use which optimizes the RC controlled manipulation of the device by a user. Accordingly the self-aligning magnetic stationary accessory for use atop a spherical RC controlled self-propelled device facilitated the toy robot spherical body with the stationary accessory allowing the user to simply and precisely navigate the spherical body FIGS. 2A and 2B show the internal drive mechanism of the self-propelled device and an arcuate support structure. The stationary accessory 14 is generally dome shaped, as seen in FIG. 3, with an internal surface and an external surface and including a curved portion of the external surface 14*a* which is held stationary on the spherical body 12 during use. An eye or indicator 18 is disposed on the stationary accessory 14 for receiving input from the RC controller in order to navigate the device or robot.

The body of the device or robot 10 is generally spherical, as seen in FIG. 1, and quite a bit larger than the stationary accessory 14, as it contains a motor and drive mechanism as discussed in more detail below. The spherical body 12 is generally hollow and includes an internal surface upon which the drive mechanism travels. As seen in FIG. 1, the spherical body, stationary accessory and RC controller are all generally manufactured from a hard durable plastic material which is simple and inexpensive to use and can be molded into any desirable shape and include fun and interesting colors and patterns.

A drive mechanism 20, as seen in FIGS. 2A and 2B, is disposed within the spherical body and includes a motor in communication with two or more wheels in the present described embodiment which ride along the interior surface of the body to propel the device or robot back and forth along a surface. The two wheel 22 of the drive mechanism 20 each with an axel that rotates independently for driving movement of the device or robot. The drive mechanism employs tank steering technology such that if a user drives both wheels forward, the device travels forward and if both wheels are driven backward, then the device travels backward, and the speed ramp up and down somewhat such that the motors change speed as well. Additionally, if one wheel is driven forward and the other wheel is driven backward, the device will spin in place.

An arcuate support member 24 is further disposed within the spherical body 12, opposite the location of the drive mechanism 20. A support post 26 is secured to the drive mechanism 20 providing a support element on which to couple the arcuate support structure at a hole or eccentric opening 34 therein where the arcuate support structure is pivotally attached. A first pair of magnets 28 disposed within the stationary accessory create attractive forces with a second pair of magnets 30 disposed within the arcuate support structure, as seen in FIG. 9.

Figure 4:
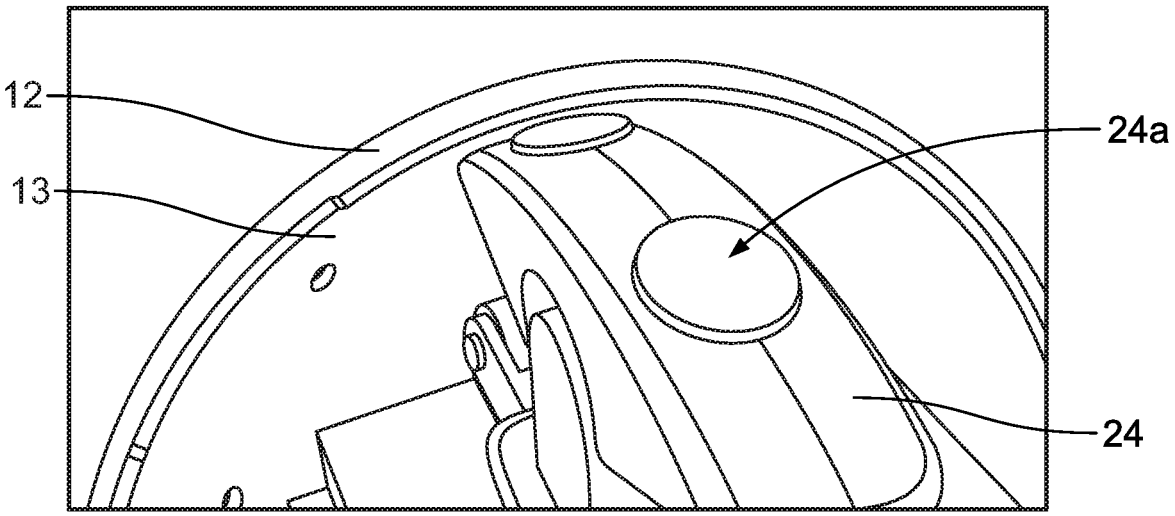
FIG. 4 is a perspective view of an end of the arcuate support structure illustrating the surface at an end of the support structure.
Figure 5:
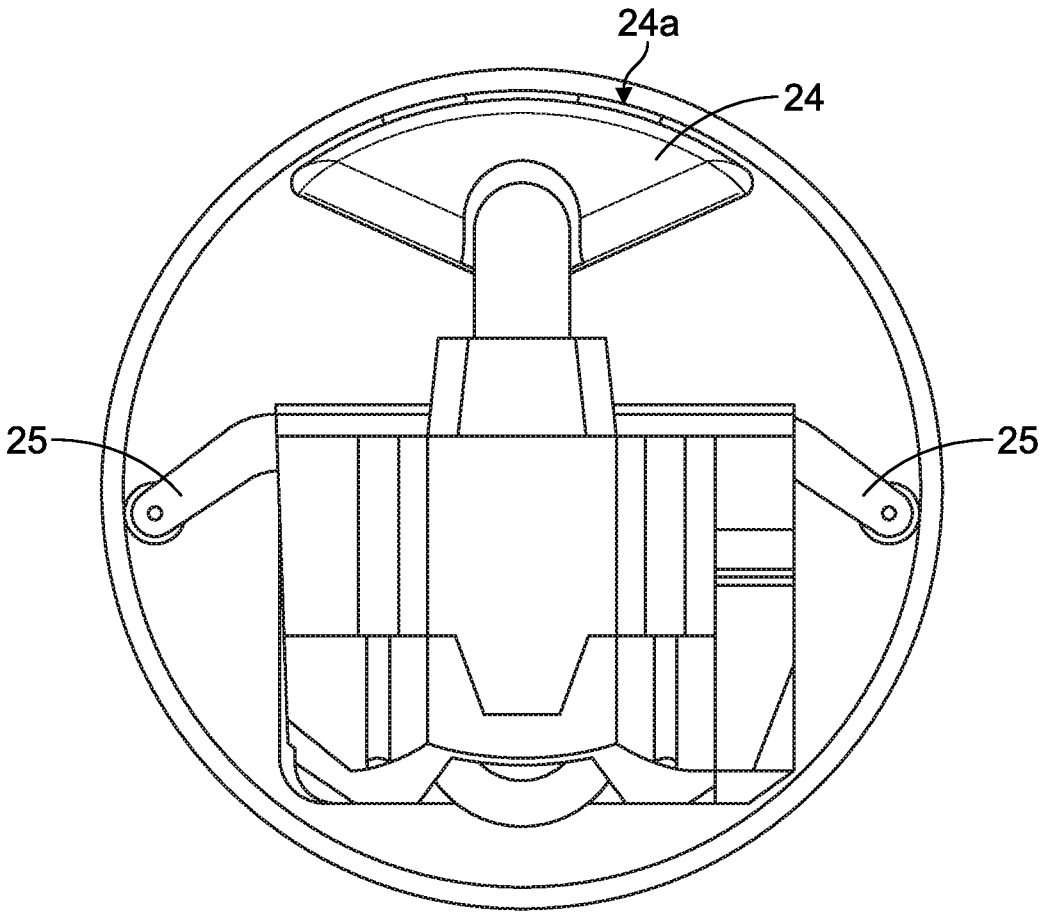
FIG. 5 is a side section view of the spherical body showing the arcuate support member within the self-propelled device or spherical toy robot.

The arcuate support member 24 as seen in FIGS. 4 and 5, includes an arcuate surface which rides along the interior surface 13 of the spherical body and includes a raised molded plastic surface 24*a* to facilitate the smooth contact between the arcuate surface and the interior surface 13 of the spherical body 12. The arcuate support member 24 may alternately be provided as a yoke, or with extending arms for positioning magnets 30. FIG. 4 is a perspective view of an end of the arcuate support structure illustrating a plastic surface at an end of the support structure. FIG. 5 provides a side section view of the spherical body showing the arcuate support member within the self-propelled device or spherical toy robot. As also seen in FIG. 5, Lateral support arms 25 are in communication with the drive mechanism for supporting the drive mechanism within the interior of the spherical body such that as the spherical body is driven in multiple directions, the drive mechanism is held steady within the spherical body.

Figure 6:
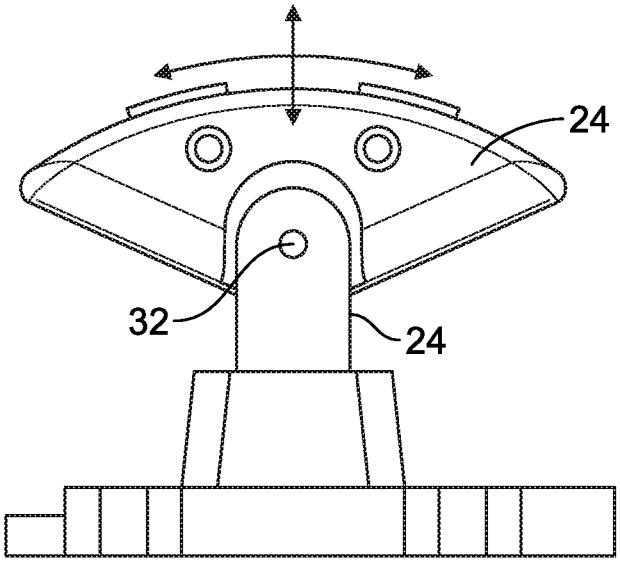
FIGS. 6, 7 and 8 illustrate the arcuate support member in various views coupled to the drive mechanism through a fixed post.
Figure 7:
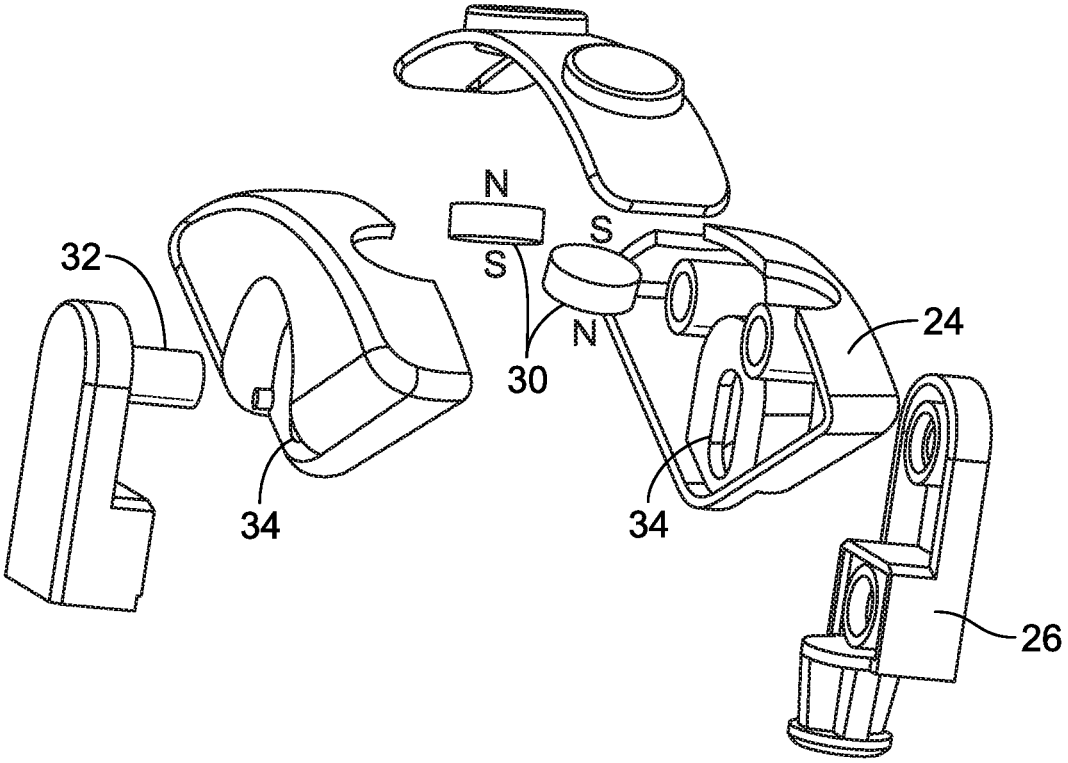
Figure 8:
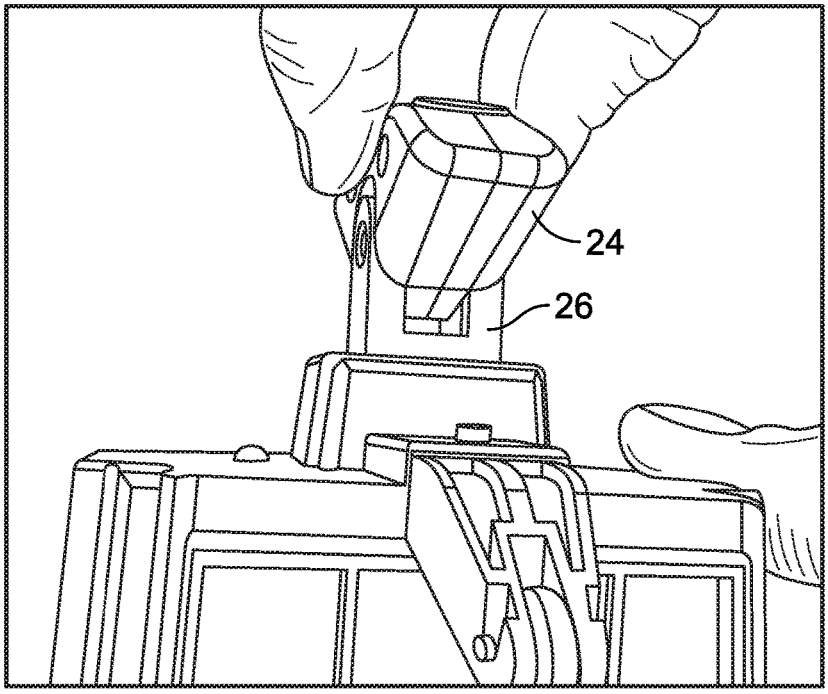

As seen in FIGS. 6 and 7 the arcuate support member 24 pivots on the fixed post 26 at pivot post 32 in various views coupled to the drive mechanism through the fixed post 26. The rocking or somewhat floating action of the arcuate support member 24 allows for the support member to adjust to variations in the interior surface 13 of the spherical body 12 (see FIGS. 4 and 9-10) as the support member rides along the spherical body. Each of the second pair of magnets has a polarity orientation opposite the other North (N) to South (S), as shown in the Figures. The second pair of magnets attract the opposite polarities of the first pair of magnets within the stationary accessory creating attractive forces that maintain the stationary assembly to the spherical body in an aligned self-oriented position indicating the specific orientation of the internal drive mechanism. The arcuate support member 24, as seen in FIG. 8, has a little space to pivot for some play in the contact between the support member 24 and the interior surface 13 of the spherical body 12.

Figure 10:
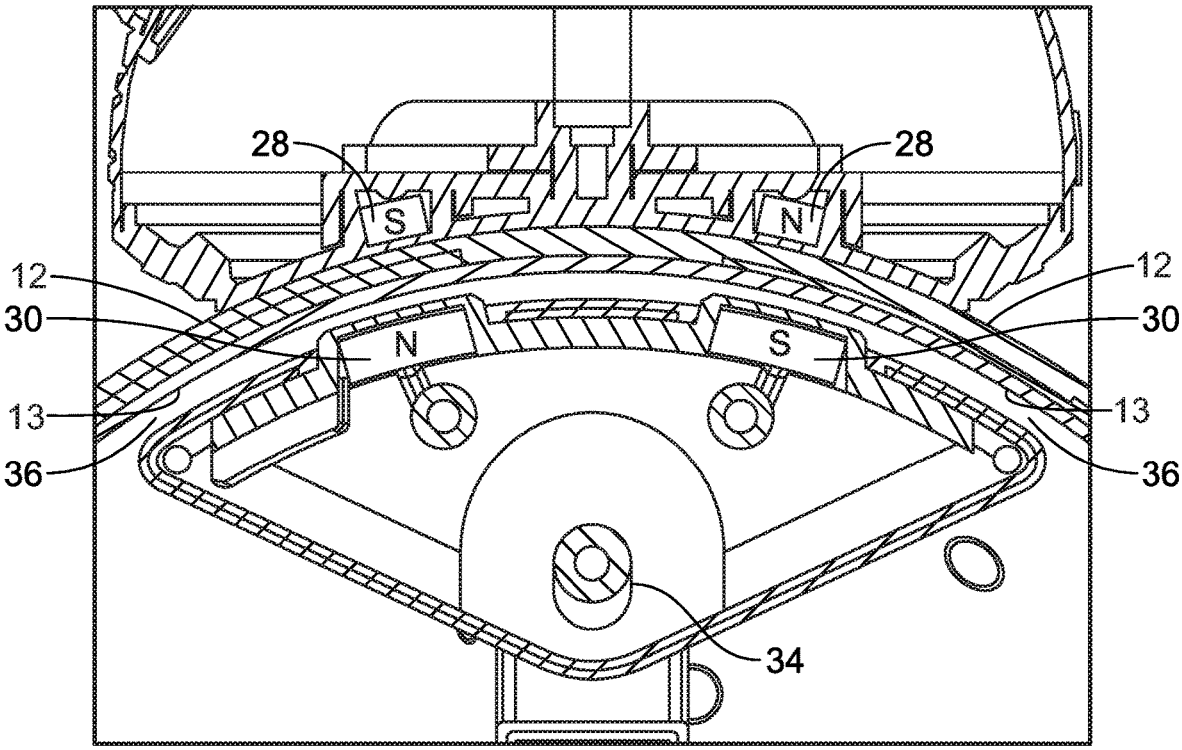
FIGS. 9 and 10 are sectional views of the spherical body illustrating the arcuate support member coupled to the drive mechanism through a fixed post for use with the stationary accessory for use atop the spherical RC controlled device.
Figure 9:
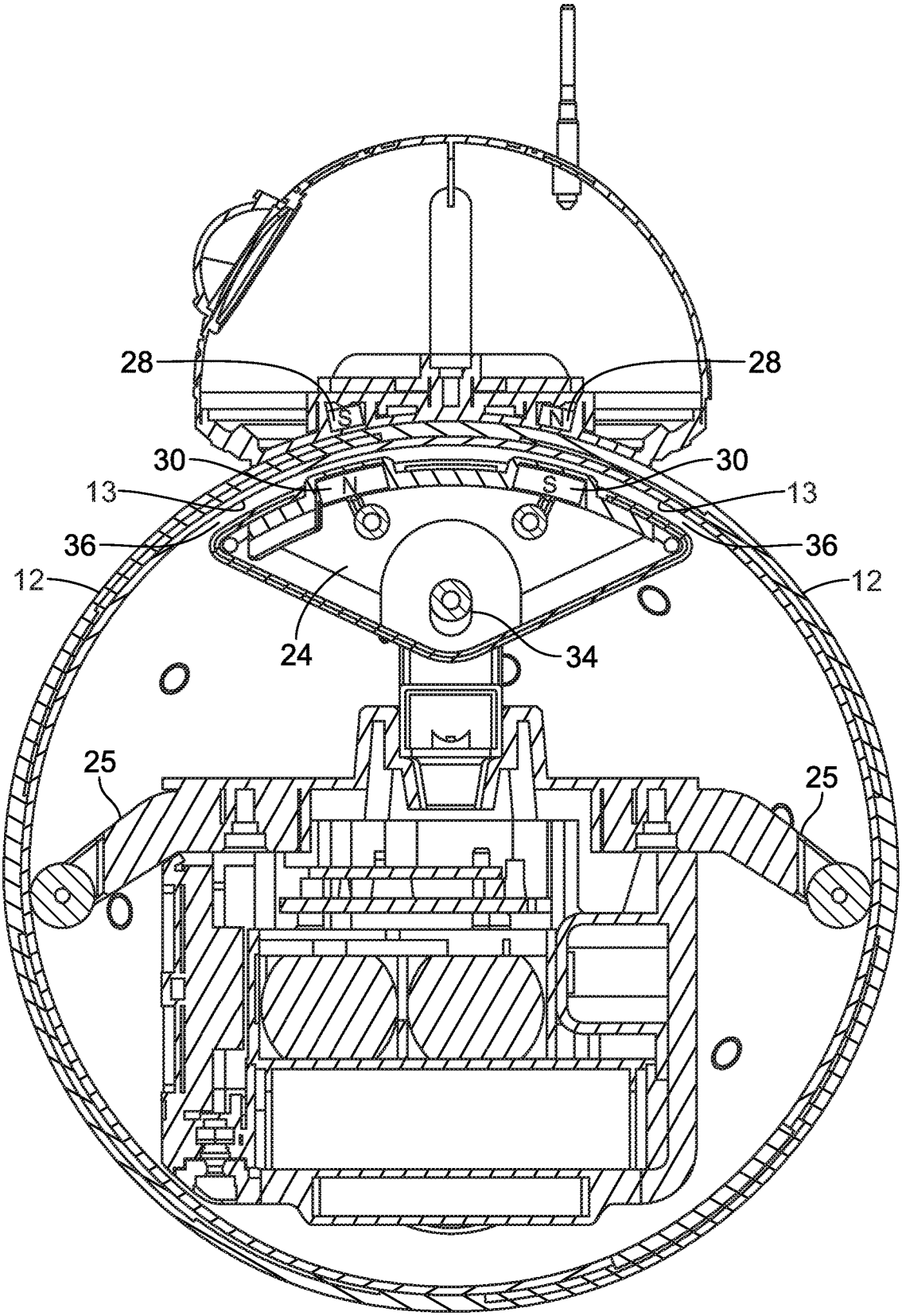

With reference to FIGS. 9 and 10 sectional views are provided to show the spherical body with the arcuate support member coupled to the drive mechanism for use with the stationary accessory atop the spherical device. The floating action of the arcuate support member 24 allows for its adjustment at 36 in the interior surface as discussed through magnetic attractive forces. The first pair of magnets 28 disposed within the stationary accessory each have a polarity orientation opposite the other magnet of the pair, as seen in FIGS. 9 and 10. Likewise, each magnet of the second pair of magnets 30 has a polarity orientation opposite the other the magnetic. Additionally, the second pair of magnets attract the opposite polarities of the first pair of magnets creating attractive forces that maintain the stationary assembly to the spherical body in an aligned self-oriented position indicating the specific orientation of the internal drive mechanism during use for optimal RC controller operations of the device or robot.

From the foregoing, it can be seen that there has been provided features for an improved spherical robot apparatus, devices and methods with a disclosure for the method of the making the apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A floating action coupling method for a support member within a spherical body without a spring therefor, the method comprising:

providing the spherical body with an interior surface that encloses a drive mechanism and the support member;

disposing a first magnetically interactive element within an accessory, the support member holding a second magnetically interactive element;

configuring the accessory for being on the outside of the spherical body with attractive forces between the first and the second magnetically interactive elements maintaining the accessory on the spherical body relative to the support member;

providing the drive mechanism with a motor in communication with a plurality of wheels which ride along the interior surface of the body; and adjusting the support member position relative to the interior surface of the spherical body with the support member coupled to the drive mechanism such that the attractive forces between the first and the second magnetically interactive elements cause the support member to float.

2. The floating action coupling method of claim 1, wherein the support member within the spherical body adjusts in the interior surface of the spherical body as the support member moves within the spherical body with the drive mechanism moving along the interior surface of the body.

3. The floating action coupling method of claim 2, providing at least one post on the drive mechanism coupling with the support member within the spherical body with the at least one post on the drive mechanism coupling to adjust in the interior surface of the spherical body as the support member moves within the spherical body with the drive mechanism moving along the interior surface of the body.

4. The floating action coupling method of claim 3, wherein the at least one post on the drive mechanism coupling with the support member comprises a pivot post and a fixed post for pivoting the support member relative to the drive mechanism.

5. The floating action coupling method of claim 4, defining an eccentric opening at the support member wherein the pivot post is configured to allow the support member to float.

6. The floating action coupling method of claim 1, wherein the first magnetically interactive element of the accessory aligns with attractive forces of the second magnetically interactive element.

7. A floating action coupling method for a support member within a spherical body without a spring therefor, the method comprising:

providing the spherical body with an interior surface that encloses a drive mechanism and the support member;

disposing a first magnetically interactive element within an accessory and disposing a second magnetically interactive element within the support member;

configuring the accessory on the outside of the spherical body using attractive forces between the first and second magnetically interactive elements to maintain the accessory on the spherical body relative to the support member;

providing the drive mechanism with a motor in communication with a plurality of wheels which ride along the interior surface of the body; and coupling the support member to the drive mechanism such that the attractive forces between the first and second magnetically interactive elements cause the support member to float and to permit the position of the support member relative to the interior surface to be adjusted.

8. The floating action coupling method of claim 7, wherein the support member adjusts relative to the interior surface of the spherical body as the drive mechanism moves along the interior surface of the spherical body.

9. The floating action coupling method of claim 8, providing at least one post on the drive mechanism coupling with the support member within the spherical body with the at least one post on the drive mechanism coupling to adjust in the interior surface of the spherical body as the support member moves within the spherical body with the drive mechanism moving along the interior surface of the body.

10. The floating action coupling method of claim 9, wherein the at least one post on the drive mechanism coupling with the support member comprises a pivot post and a fixed post for pivoting the support member relative to the drive mechanism.

11. The floating action coupling method of claim 10, defining an eccentric opening at the support member wherein the pivot post is configured to allow the support member to float.

12. The floating action coupling method of claim 7, wherein the first magnetically interactive element of the accessory aligns with attractive forces of the second magnetically interactive element of the support member within the spherical body and orients the accessory on the spherical body to indicate the orientation of the drive mechanism.

13. A self-propelled device with a spherical body having an interior surface that encloses a drive mechanism and a support member within the spherical body, comprising:

a plurality of wheels at the drive mechanism;

a motor in communication with the plurality of wheels to cause the drive mechanism to ride along the interior surface of the body;

an accessory configured to be positioned on the outside of the spherical body;

a first magnetically interactive element disposed within the accessory;

a second magnetically interactive element disposed within the support member to maintain the accessory on the spherical body relative to the support member; and a coupling to position the support member in relation to the drive mechanism without a spring such that the attractive forces between the first and second magnetically interactive elements cause the support member to float and to permit the position of the support member relative to the interior surface to be adjusted.

14. The self-propelled device of claim 13, wherein the first magnetically interactive element comprises a first pair of magnets with the first pair magnets oriented in the accessory with a North (N) to South (S) polarity orientation opposite each other, and wherein the second magnetically interactive element comprises a second pair of magnets with the second pair magnets oriented in the support member with a North (N) to South (S) polarity orientation opposite each other.

15. The self-propelled device of claim 13, wherein the drive mechanism comprises a controller in communication with the motor for rotating the plurality of wheels independently to steer the self-propelled device.

16. The self-propelled device of claim 13, wherein the first magnetically interactive element of the accessory aligns with attractive forces of the second magnetically interactive element of the support member within the spherical body and orients the accessory on the spherical body to indicate the orientation of the drive mechanism.

17. The self-propelled device of claim 13, wherein the first magnetically interactive element of the accessory aligns with attractive forces of the second magnetically interactive element of the support member within the spherical body and maintains the accessory stationary in relation to the spherical body.

18. The self-propelled device of claim 13, wherein the coupling comprises a post on the drive mechanism.

19. The self-propelled device of claim 18, comprising an eccentric opening defined at the support member for adjusting the support member and to allow the support member to pivot relative to the post on the drive mechanism.

20. The self-propelled device of claim 13, wherein the coupling comprises at least one post on the drive mechanism coupling with the support member to adjust the support member and to allow the support member to float.

* * * * *